United States Patent [19]

Hushbeck et al.

[11] Patent Number: 4,651,829

[45] Date of Patent: Mar. 24, 1987

[54] SUBSURFACE CONTROL VALVE

[75] Inventors: Donald F. Hushbeck; Kenneth D. Caskey, both of Duncan, Okla.

[73] Assignee: Halliburton Company, Duncan, Okla.

[21] Appl. No.: 808,691

[22] Filed: Dec. 13, 1985

[51] Int. Cl.[4] ..... E21B 34/12

[52] U.S. Cl. ..... 166/332; 166/322

[58] Field of Search ..... 166/332, 334, 322, 324, 166/373, 386, 387

[56] References Cited

U.S. PATENT DOCUMENTS

| | | | |
|---|---|---|---|
| 3,236,255 | 2/1966 | Sizer | 166/322 X |
| 3,253,655 | 5/1966 | Brown | 166/120 |
| 3,306,363 | 2/1967 | McZilkey, Jr. | 166/152 |
| 3,306,366 | 2/1967 | Muse | 166/334 |
| 3,356,140 | 12/1967 | Young | 166/128 |
| 3,570,595 | 3/1971 | Berryman | 166/128 |
| 3,763,933 | 10/1973 | Mott | 166/322 |
| 3,796,257 | 3/1974 | Hudson | 166/322 X |
| 4,253,521 | 3/1981 | Savage | 166/123 |
| 4,290,484 | 9/1981 | Beall et al. | 166/242 |
| 4,334,581 | 6/1982 | Arendt | 166/324 |
| 4,372,388 | 2/1983 | Skinner | 166/334 |
| 4,372,391 | 2/1983 | Barrington et al. | 166/373 |
| 4,372,392 | 2/1983 | Barrington et al. | 166/373 |

OTHER PUBLICATIONS

Halliburton Services Catalog No. 40, p. 3477.

*Primary Examiner*—James A. Leppink
*Assistant Examiner*—Thuy M. Bui
*Attorney, Agent, or Firm*—Joseph A. Walkowski

[57] ABSTRACT

A full opening subsurface control valve for use in subsurface closure of a well annulus. The valve includes a body with a sleeve reciprocably disposed in the valve body. The body is releasably attached to an upper tool string portion, and the sleeve is attached to a lower tool string portion. An actuator arm, mounted on the body and stationary with respect thereto, engages a ball valve element. When the body and sleeve are in a relatively converged position, the ball valve element is in a closed position. When the body and sleeve are in a relatively extended position, the ball valve is in an open position, such that the ball valve element, body and sleeve define a substantially unobstructed flow passage through the valve. A spring is utilized for relatively biasing the body and sleeve toward the converged position. The weight of the lower tool string portion overcomes the spring force such that the valve is maintained in an open position as it is longitudinally positioned in the well bore. A pressure balancing piston is provided for balancing forces exerted by test pressurization of the valve so that undesired opening of the valve is prevented.

19 Claims, 10 Drawing Figures

SUBSURFACE CONTROL VALVE

BACKGROUND OF THE INVENTION

1. Field Of The Invention

This invention relates to subsurface control valves used in closing off a well annulus in situations where necessary such as a storm on an offshore location, and more particularly, to a subsurface control valve having a substantially unobstructed flow passageway therethrough and having a valve element in a normally open position as the tool string is lowered into the well.

2. Description Of The Prior Art

A subsurface control valve using a sliding inner sleeve valve element within an outer sleeve is disclosed in U.S. Pat. No. 4,372,388 to Skinner. In this valve, openings in the inner sleeve are aligned with openings in the outer sleeve for flow therethrough. Fluid may flow down a central opening through the tool string, pass through these transverse openings into an annulus around the other sleeve and thus downward to the lower tool string portions. Such an arrangement results in pressure drop through the valve. The present invention has a totally unobstructed flow passageway when the valve is in an open position, and thus pressure drop therethrough is virtually eliminated.

The valve of Skinner is attached to a stinger assembly and is in a normally open position as the valve is run into the well. To close the valve, rotation of the stinger assembly is required, after which it may be removed from the well bore. To reattach and reopen the valve, the stinger assembly is run back into the well and rotatingly engaged with the valve assembly by rotating in the direction opposite to that required for disengagement. The subsurface control valve in the present invention is maintained in an open position by tension due to the weight of the tool string elements below it, and the valve is closed by simple movement of the tool string when the tension on it is released.

Use of a pressure balancing piston in a packer is disclosed at page 3477 of Halliburton Services Catalog No. 40. Typical examples of other subsurface control apparatus are disclosed in U.S. Pat. No. 3,356,140 to Young and U.S. Pat. No. 3,570,595 to Berryman. None of these references discloses a normally open subsurface control valve having a fully unobstructed flow passage therethrough which is held in an open position by the weight of the tool string elements below the valve, or which utilizes a retrieving mechanism such as in the present invention.

SUMMARY OF THE INVENTION

The subsurface control valve of the present invention is adapted for positioning between upper and lower portions of a tool string and comprises annular body means defining a central opening therein and having an end adapted for maintaining the valve means in the open position and to relative movement of the upper and lower tool string portions for attachment to one of an upper and a lower tool string portion, sleeve means reciprocably disposed in the body means central opening and having an end extending from the body means adapted for attachment to the other of the upper and lower tool string portions, valve means in operative association with the body and sleeve means and having an open position and a closed position, and valve actuation means responsive to the weight of the lower tool string portion for alternately moving the valve means between the open and closed positions thereof. When the valve means is in the open position, the valve means, body means and sleeve means define a substantially unobstructed flow passage through the valve.

The body means is preferably characterized by an outer body portion, and the sleeve means is preferably characterized by an inner sleeve portion slidably positioned in the body central opening.

The valve means comprises a seat disposed on the sleeve means and a valve element in operative association with the seat and movable between the open and closed positions. Preferably, the valve element is a ball valve element pivotally mounted on the seat.

The valve actuation means comprises an actuator arm attached to the body means in the central opening thereof. The actuator arm is stationary with respect to the body means and is engaged with the valve means such that, as the sleeve means is reciprocated with respect to the body means, the actuator arm causes the valve means to be alternately moved between its open and closed positions. In the preferred ball valve embodiment, the actuator arm engages a slot in the ball valve element.

As the body means and sleeve means are relatively reciprocated from a relatively converged to a relatively open position, the valve means is respectively moved from the closed to the open position.

Biasing means, disposed between the body means and the sleeve means, are provided for biasing the body means and sleeve means toward the relatively converged position, although not generally sufficient to automatically close the valve means. In the preferred embodiment, the body means has an inwardly extending shoulder in the central opening thereof and the sleeve means has an outwardly extending shoulder thereon, and the biasing means is characterized by a compression spring positioned between the shoulders biasing the shoulders apart.

The force exerted by the weight of the lower portion or the tool string is greater than the maximum force exerted by the biasing means, such that the sleeve means and body means are maintained in the relatively extended position as the tool string is longitudinally positioned in a well bore. The valve means is closed by setting down weight from the upper tool string portion. The biasing means acts to maintain the valve means in the closed position and prevent unintentional opening thereof.

Preferably, the subsurface control valve further comprises pressure balancing means for balancing pressure forces exerted by pressurization of the flow passage during testing of the integrity of the seal of the valve means when the valve means is in the closed position. This balancing of pressure and forces assures that the body means is not "pumped upward" by the pressure differential. Thus, undesired opening of the valve means is prevented.

The body means defines a substantially annular piston receiving cavity therein, and the pressure balancing means is characterized by an annular piston which is reciprocably and sealingly disposed in the piston receiving cavity. The piston divides the piston cavity into a first, lower portion and a second, upper portion. A first fluid connection is provided between the piston cavity first portion and the valve flow passage. A second fluid connection is provided between the piston cavity second portion and the well annulus, so that well annulus pressure is maintained in the second piston cavity portion.

The subsurface control valve of the present invention may be used as part of a downhole tool comprising packer means forming a part of the lower tool string portion and having a set position sealingly closing a bore of a well, the subsurface control valve connected to the packer, releasable connecting means for releasably connecting the valve to the upper tool string portion, and means for closing the valve by longitudinally moving the upper tool string portion when the packer means is in the set position thereof.

As the downhole tool is lowered into the well bore, the control valve is maintained in an open position as hereinbefore described. The packer may be set, relieving the weight of the lower tool string portion from the valve. When tension is thus released, the upper tool string portion may be moved downwardly toward the valve to force the valve to the closed position.

An important of the invention is to provide a subsurface control valve having a substantially unobstructed flow passage therethrough.

Another object of the invention is to provide a subsurface control valve which is maintained in an open position by the weight of a drill string portion therebelow.

A further object of the invention is to provide a subsurface control valve with pressure balancing means for balancing pressures in the valve so that the valve is maintained in a closed position when test pressure is applied above the valve.

Still another object of the invention is to provide a downhole tool having a packer, full opening subsurface control valve and releasable connecting means for releasably attaching the connecting tool to a drill string.

Additional objects and advantages of the invention will become apparent as the following detailed description of the preferred embodiment is read in conjunction with the accompanying drawings which illustrate such preferred embodiment.

DESCRIPTION OF THE PREFERRED EMBODIMENT

Figure 1A:
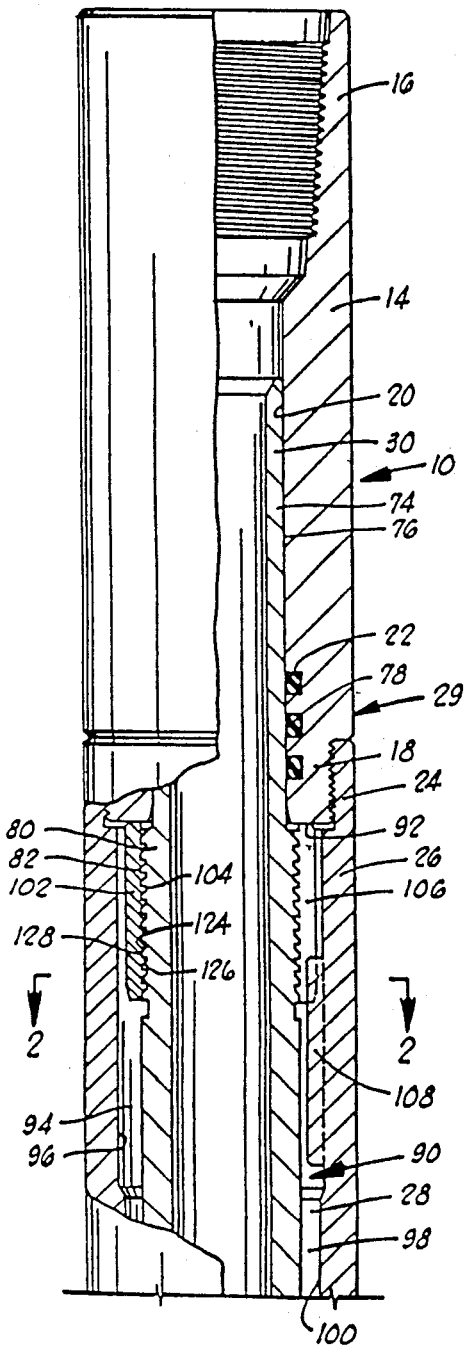
FIGS. 1A–1D show a partial longitudinal cross section of the apparatus of the present invention.

Referring now to the drawings, and more particularly to FIGS. 1A–1D, the apparatus of the present invention is shown with a retrieving mechanism, generally designated by the numeral 10, and a subsurface control valve, generally designated by the numeral 12. FIGS. 1A–1D show the retrieving mechanism 10 in a position just after engagement with control valve 12. Valve 12 is in a closed position.

Retrieving mechanism 10 includes a body 14 having an upper threaded end 16 for engagement with a tool string and a lower end 18. Body 14 defines a central opening 20 therethrough with a plurality of seal cavities 22 adjacent lower end 18.

Lower end 18 of body 14 is preferably threadingly engaged with upper end 24 of a sleeve 26 which defines a central opening 28 therethrough in communication with central opening 20 of body 14. Body 14 and sleeve 26 thus form overshot means characterized by an overshot 29 used in a manner hereinafter described.

Retrieving mechanism 10 further includes mandrel means in the form of an elongated mandrel 30 extending upwardly from valve body 32 of control valve 12, and threadingly engaged therewith. Mandrel 30 defines a central opening 34 therethrough which corresponds to, and is aligned with, opening 36 defined in valve body 32.

Control valve 12 includes sleeve means reciprocably disposed in an annular body means. The body means is best characterized by a valve body 32 which preferably includes an upper collar 38 attached to an upper end of a ring 40. An intermediate sleeve 42 is attached to the lower end of ring 40, and the intermediate sleeve is attached at its lower end to a housing 44. Housing 44 is threadingly engaged with a lower collar 46. Valve body 32 further defines a general central opening 48 therethrough of varying diameters.

The sleeve means of control valve 12 includes a valve sleeve assembly 50 reciprocably disposed in central opening 48 of body 32. Valve sleeve assembly 50 preferably includes shouldering mandrel 52 threadingly engaged with an upper valve sleeve 53 having an upper valve seat 54 mounted thereon, a lower valve sleeve 56 with a lower valve seat 58 mounted at an upper end of the lower sleeve. Lower valve sleeve 56 is threadingly engaged with a shouldering sleeve 60, and the shouldering sleeve is threadingly engaged with a lower adapter 62. Adapter 62 has a lower end 64 adapted for threading engagement with a downhole tool or tool string.

Rotatably positioned between upper valve seat 54 and lower valve seat 58 is a ball valve element 66 having a recess 68 therein and providing valve means for alternately opening and closing control valve 12. Annularly positioned between ring 40 and housing 44 of body 32, and radially within intermediate sleeve 42, are a pair of actuators 70, each having an actuator arm 72 thereon which extends into, and engages, recess 68 in ball valve element 66. Upper valve sleeve 53 and lower valve sleeve 56 are held in place about ball valve element 66 by a pair of longitudinally oriented C-clamps which extend from above to below ball valve element 66 and lock into slots (not shown) in the valve sleeves. The arrangement is known in the art and is disclosed in U.S. Pat. No. 3,814,182 to Giroux assigned to Halliburton Company and hereby incorporated herein by reference.

Referring now to FIG. 1A, mandrel 30 includes an upper portion 74 having an outside diameter defining a sealing surface 76 thereon. Upper portion 74 extends into central opening 20 of body 14 when in the position shown in FIG. 1A. Each seal cavity 22 holds a seal 78 therein, such as an O-ring, for sealing engagement between sealing surface 76 of mandrel 30 and body 14 of overshot 29.

An intermediate portion 80 of mandrel 30 defines an externally threaded surface 82 thereon and an outwardly directed annular shoulder 84 positioned below the threaded surface.

Sleeve 26 of overshot 29 includes an inwardly directed, upwardly facing annular shoulder 86 and an inner surface 87 in close spaced relationship to outer surface 88 of mandrel 30. It will be seen that a substantially annular recess or cavity 90 is defined between sleeve 26, shoulder 86, mandrel 30 and a downwardly facing annular shoulder formed by lower surface 92 of body 14. Cavity 90 includes a first, upper portion 94 having a substantially constant inside diameter 96 and a second, lower portion 98 with a substantially constant inside diameter 100. In the preferred embodiment, inside diameter 100 is less than inside diameter 96.

Figure 2:
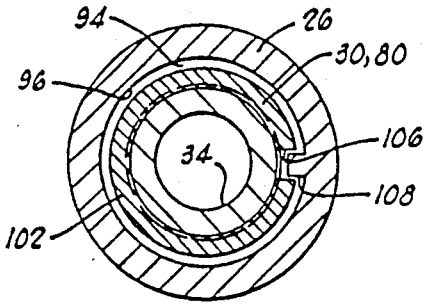
FIG. 2 is a transverse cross section taken along lines 2—2 in FIG. 1A.

Referring now to FIGS. 1A and 2, a ring 102 of substantially C-shaped cross section is longitudinally slidably disposed in cavity 90. Ring 102, which may be referred to as a C-ring, has a threaded internal surface 104 engageable with threaded surface 82 of intermediate portion 80 of mandrel 30. The C-shaped cross section of ring 102 thus defines a longitudinal slot 106 therealong.

Extending radially inwardly on sleeve 26, and preferably positioned in upper portion 94 of cavity 90 is a substantially longitudinal key 108 adapted for engagement with slot 106 in ring 102. Preferably, key 108 is of sufficient length such that it always engages slot 106 regardless of the longitudinal position of ring 102 within cavity 90.

Figure 1B:
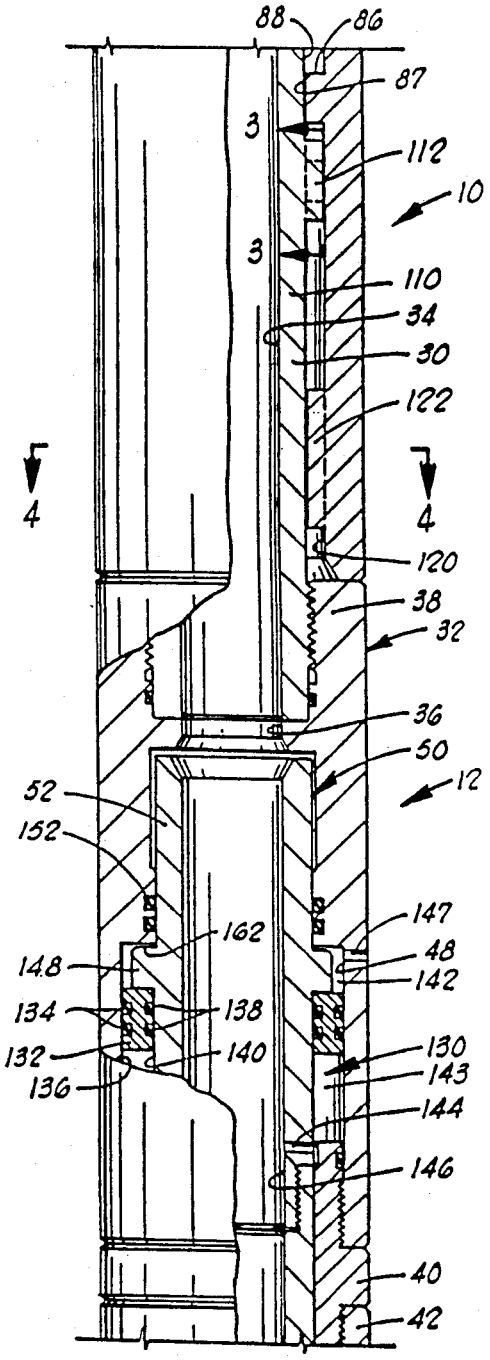
Figure 3:
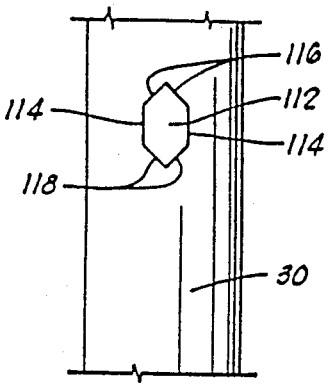
FIG. 3 illustrates a partial elevation of a mandrel as viewed along lines 3—3 in FIG. 1B.
Figure 4:
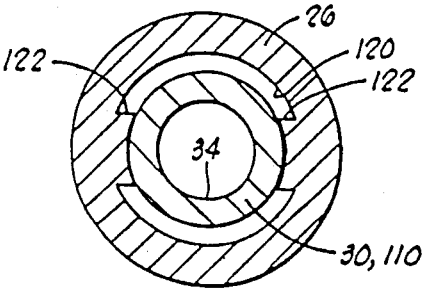
FIG. 4 shows a transverse cross section taken along lines 4—4 in FIG. 1B.

Referring now to FIGS. 1B, 3 and 4, mandrel 30 further includes a lower portion 110 having at least one substantially longitudinal lug 112 extending radially outwardly therefrom. Each lug 112 has a pair of longitudinal sides 114, an upper transverse end defined by a pair of sides 116 extending at an acute angle to sides 114, and thus to a central axis of the apparatus, and a lower transverse end defined by similarly angled sides 118.

Extending radially inwardly from inner surface 120 of sleeve 26 is at least one substantially longitudinal lug 122. Lug 122 has longitudinal sides and upper and lower transverse ends defined by angled sides in a manner similar to lug 112 on mandrel 30.

Threaded surface 82 on intermediate portion 80 of mandrel 30 and threaded surface 104 in ring 102 each defines a thread with a profile having a first surface 124 which extends at an acute angle with respect to the central axis of the apparatus and a second surface 126 opposite the first surface which extends substantially normal to the central axis. The thread profile also preferably includes a cylindrical outer surface 128.

During assembly, mandrel 30 is longitudinally inserted in overshot 29. Thus, seal surface 76 is inserted into central opening 20 of body 14 and sealingly engaged by seals 78. Ring 102 is made of a sufficiently resilient material, such as hardened steel, so that it will expand radially outwardly and contract radially inwardly in a ratcheting manner as mandrel 30 is forced into the ring. Angled surfaces 124 on the threads facilitate the longitudinal insertion of mandrel 30 into ring 102. As threaded surfaces 82 and 104 are aligned, ring 102 will contract to a normal position in which the threaded surfaces are in threaded engagement.

Normal surfaces 126 of the threads prevent axial disengagement of mandrel 30 and ring 102. Disengagement may only be accomplished by rotating overshot 29 with respect to mandrel 30 for threading disengagement. Thus, releasable connecting means are provided for threadingly connecting the overshot means to the mandrel means upon longitudinal insertion of the mandrel means into the overshot means, and for disconnecting the overshot means from the mandrel means upon rotation of the overshot means relative to the mandrel means.

Preferably, threaded surfaces 82 and 104 comprise lefthand threads so that right-hand rotation of overshot 29 is all that is required. In this way, reverse rotation of the tool string is eliminated.

Referring again in FIG. 1B, it will be seen that upper collar 38 and ring 40 of body 32 of control valve 12, along with upper sleeve 52 of valve sleeve assembly 50 define a substantially annular piston cavity 130 therebetween.

Reciprocably positioned in piston cavity 130 is a substantially annular piston 132 with outer piston rings or seals 134 for sealing engagement with outside diameter 136 of the piston cavity. Inner piston rings 138 provide sealing engagement with inside diameter 140 of piston cavity 130. Outer piston rings 134 and inner piston rings 138 are preferably O-rings. It will be seen that piston 132 divides piston cavity 130 into an upper portion 142 and a lower portion 143.

A transverse opening 144 in upper sleeve 52 adjacent a lower end of piston cavity 130 provides fluid communication between central opening 146 of sleeve assembly 50 and lower portion 143 of the piston cavity. At the upper end of piston cavity 130, a transverse opening 147 in upper collar 38 provides fluid communication between upper portion 142 of the piston cavity and a well annulus between the apparatus and a well casing in which the apparatus is located.

A shoulder portion 148 extends radially outwardly from an intermediate portion of shouldering mandrel 52 in upper portion 142 of piston cavity 130 at a point above piston 132. It will be seen that seals 150 in ring 40, shown in FIG. 1C, and seals 152 in upper collar 38, shown in FIG. 1B, sealingly enclose annular piston cavity 130 regardless of the relative position between sleeve assembly 50 and body 32 of control valve 12.

Figure 1C:
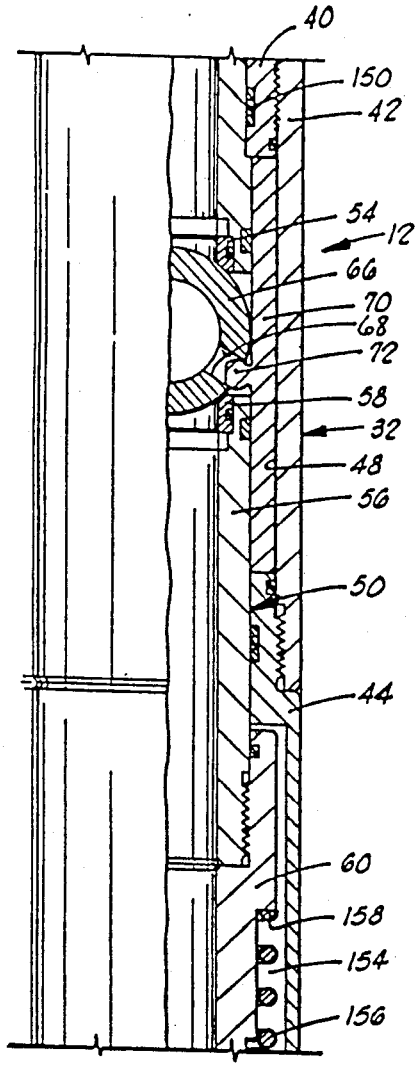
Figure 1D:
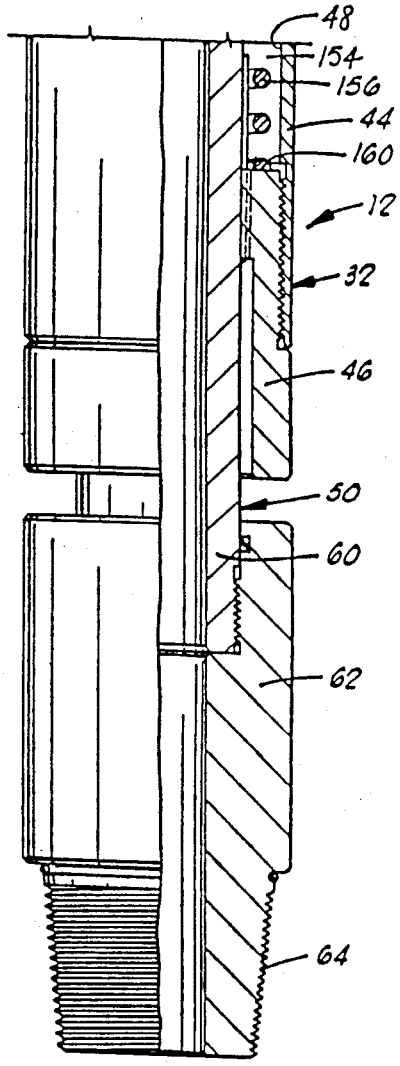

Referring now to FIGS. 1C and 1D, housing 44, lower collar 46 and shouldering sleeve 60 define a substantially annular spring receiving cavity 154 therein. A compression spring 156 is positioned in cavity 154 and bears against shoulder 158 of shouldering sleeve 60 and upper shoulder surface 160 of lower collar 46. Preferably, spring 156 is always in compression so that shoulder 158 and upper shoulder surface 160 are oppositely biased. It will be seen that this spring force thus provides a means for biasing valve sleeve assembly 50 to a relatively converged position with respect to body 32 such that shoulder 148 of shouldering mandrel 52 is adjacent annular shoulder 162 in upper collar 38, as shown in FIG. 1B.

OPERATION OF THE APPARATUS

Referring now to FIGS. 1A–1D and 5–7, an operating sequence of retrieving mechanism 10 and subsurface control valve 12 will be described as used in conjunction with a packer 164.

Figure 5:
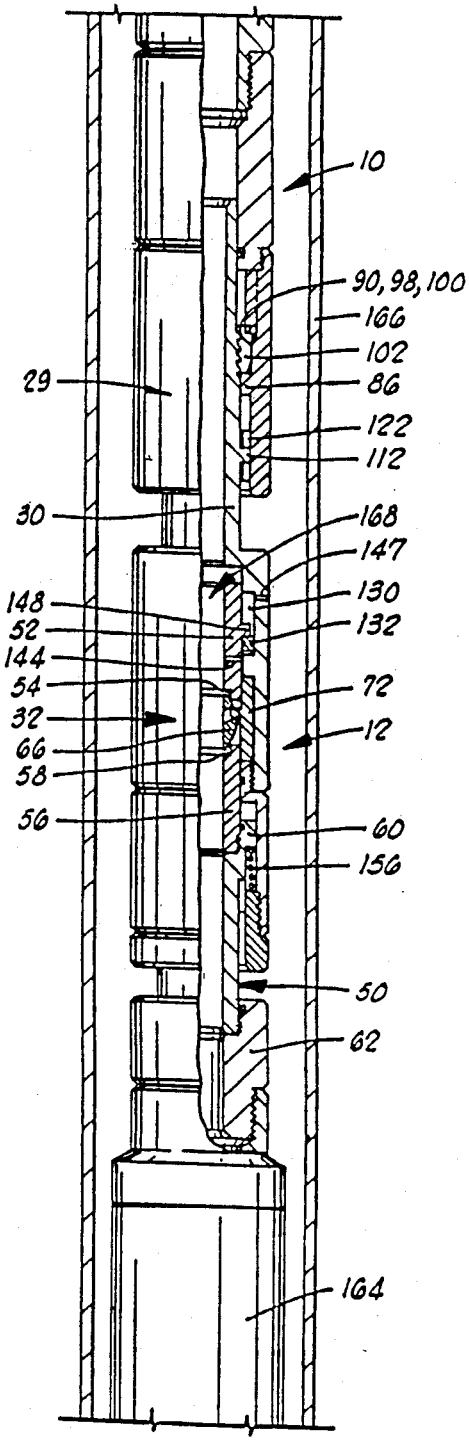
FIG. 5 is a schematic partial cross section of the retrieving mechanism, subsurface control valve and packer as the assembly is lowered into a well casing.

When the apparatus is lowered into a well casing 166, it is in the configuration shown in FIG. 5. Packer 164 is attached to adapter 62 at the lower end of valve sleeve assembly 50. Threaded portion 82 of mandrel 30 is engaged with threaded surface 104 of ring 102 in overshot 29. The weight of control valve 12, packer 164 and any tool string elements below the packer forces mandrel 30 to a downward position with respect to overshot 29 in which ring 102 is located in small, lower portion 98 of cavity 90 and bearing against shoulder 86. As already indicated, expansion of ring 102 is prevented in this position, and the shape of the threads prevent longitudinal disengagement of mandrel 30 with the ring.

A study of the extended position of FIG. 5 will show that lug 112 on mandrel 30 and lug 122 in overshot 29 are longitudinally aligned with one another. Thus, rotation of overshot 29 will rotate mandrel 30, and therefore control valve 12 and all elements of the tool string therebelow, without threading disengagement of the mandrel with ring 102.

The weight of packer 164 and of the tool string elements therebelow is sufficient to overcome to force exerted by spring 156 so that the spring is further compressed. Valve sleeve assembly 50 of control valve 12 is thus in a relatively extended position with respect to body 30. The result is that shouldering mandrel 52 and lower sleeve 56 which support ball valve element 66 are downwardly displaced with respect to actuator arm 72 which is stationary in body 30. Actuator arm 72 thus acts as a valve actuation means for causing ball valve element 66 to rotate within upper seat 54 and lower seat 58 to a fully open position shown in FIG. 5. As long as the weight overcomes the force of spring 156, means are thus also provided for maintaining control valve 12 in an open position when lowered into the well bore. It will be seen by those skilled in the art that retrieving mechanism 10 and control valve 12 define a substantially unobstructed central flow passage 168 therethrough when the valve is in the open position.

In the relatively extended position of control valve 12 shown in FIG. 5, piston 132 is displaced to the lower end of cavity 130 by shoulder 148. Fluid from the well annulus flows through transverse opening 147 into cavity 130. Thus, transverse opening 147 prevents a possible vacuum in cavity 130.

Figure 6:
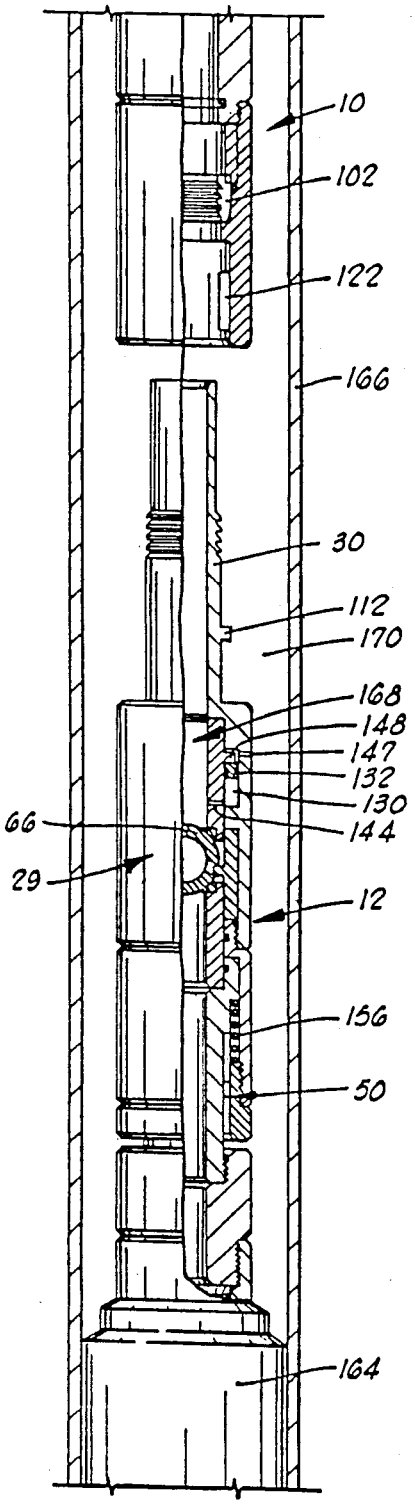
FIG. 6 schematically illustrates the packer in an expanded position with the retrieving mechanism disengaged from the subsurface control valve.
Figure 7:
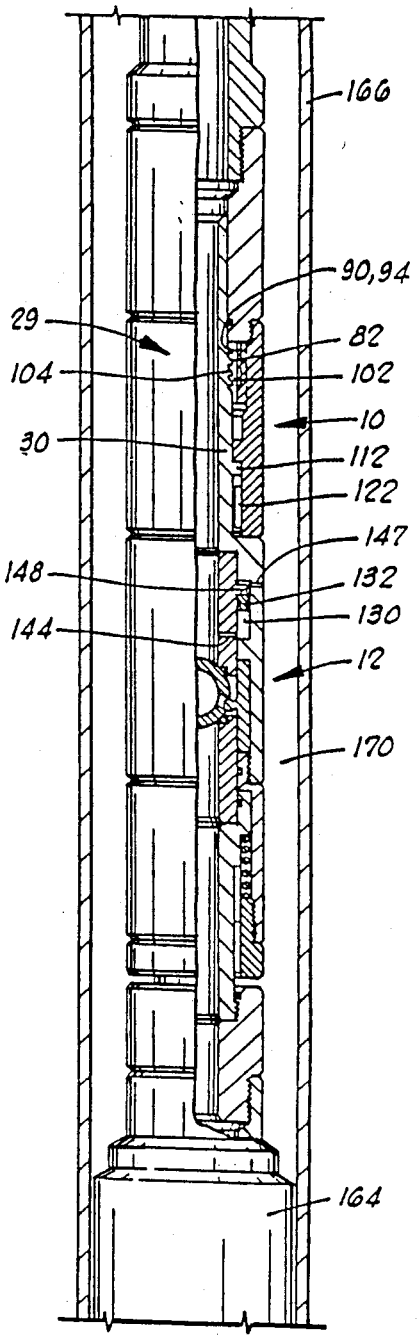
FIG. 7 is a schematic showing the retrieving mechanism as it is re-engaged with the subsurface control valve.

When it is desirable to close off well casing 166, packer 164 is actuated in a manner known in the art to the position shown in FIG. 6 in which it is sealingly engaged with an inner surface of the well casing. Packer 164 is preferably retrievable. When packer 164 is engaged, it will support the weight of any tool string elements below it.

After engagement of packer 164, overshot 29 may be moved downwardly with respect to mandrel 30 and control valve 12 such that lugs 112 and 122 are no longer engaged, as best shown in FIG. 1B. This downward displacement of overshot 29 relieves tension on mandrel 30. Further downward displacement of overshot 29 moves body 32, and thus mandrel 30, downwardly with respect to valve sleeve assembly 50 which is stationary in the well along the packer 164. It will be seen by those skilled in the art that in this relatively converged position of control valve 12, ball valve element 66 is rotated back to a closed position, obstructing central flow passage 168. Thus, means are provided for closing valve 12.

After the initial relief of tension on mandrel 30, the force exerted by spring 156 and the weight of the valve body will generally be sufficient to automatically close control valve 13.

In the relatively converged, closed position of control valve 12, shoulder 148 on valve sleeve assembly 50 is moved relatively upwardly so that it is again adjacent shoulder 162 in body 32. When body 32 and valve sleeve assembly 50 are thus relatively converged, the total volume of central flow passage 168 above valve element 66 is reduced.

Balancing piston 132 provides an upward force on shoulder 148 whenever central flow passage 168 is pressured up to test the integrity of the seal of ball valve element 66 on lower seat 58. This upward force balances the forces created by the pressure increase in central flow passage 168 to assure that valve body 32 of control valve 12 is not "pumped upward" by the pressure differential which would open the ball valve element 66.

When overshot 29 is moved toward control valve 12, lug 112 on mandrel 30 and lug 122 in overshot 29 are no longer engaged which permits relative rotation of the overshot and mandrel. Rotation of the overshot thus threadingly disengages ring 102 from mandrel 30. As previously indicated, use of the preferred left-hand threads for mandrel threaded portion 82 and ring threaded surface 104 allows right-hand rotational disengagement. Reverse rotation and the possibility of undesired disengagement of other joints in the tool string are avoided. After disengagement, overshot 29 may be removed from well annulus 166, as shown in FIG. 6.

Spring 156 provides a biasing means for maintaining control valve 12 in the closed position when overshot 29 is disengaged from mandrel 30.

To retrieve control valve 12 along with packer 164 and the tool string elements below the packer, it is only necessary to lower overshot 29 back into well annulus 166 and stab the overshot over mandrel 30. During the stab-over operation, best illustrated in FIG. 7, threaded surface 82 of mandrel 32 will force ring 102 into upper portion 94 of cavity 90, again allowing ratcheting expansion of ring 102 so that the mandrel threaded surface engages threaded surface 104 of the ring as hereinbefore described.

After re-engagement, overshot 29 is raised with respect to control valve 12 to force the control valve into the open position thereof and to engage lugs 112 and 122. As this occurs, shoulder 148 again forces piston 132 relatively downwardly in piston cavity 130 so that fluid in lower portion 143 of the piston cavity is forced through opening 144 into central flow passage 168, again compensating for the change in volume in the flow passage and maintaining a substantially constant pressure in control valve 12.

Packer 164 may then be disengaged, and the entire tool string lifted out of well casing 166, again as shown in FIG. 5.

It can be seen, therefore, that the retrieving mechanism and subsurface control valve of the present invention are well adapted to carry out the ends and advantages mentioned as well as those inherent therein. While a presently preferred embodiment of the apparatus has been shown for the purposes of this disclosoure, numerous changes in the construction and arrangement of the parts may be made by those skilled in the art. All such changes are encompassed within the scope and spirit of this invention as defined by the appended claims.

What is claimed is:

1. A subsurface control valve for use in a tool string, said subsurface control valve comprising:

annular body means defining a central opening therein and having an end adapted for attachment to one of an upper and a lower tool string portion;

sleeve means reciprocably disposed in said body means central opening and having an end extending from said body means, said sleeve means end being adapted for attachment to the other of said upper and said lower tool string portions;

valve means in operative association with said body means and said sleeve means, said valve means having an open position in which said valve means, body means and sleeve means define a substantially unobstructed flow passage therethrough and a closed position; and valve actuation means responsive to the weight of said lower tool string portion for maintaining said valve in said open position and to relative movement of said upper and lower tool string portions for alternately moving said valve means between said open position and said closed position.

2. The control valve of claim 1 further comprising pressure balancing means for balancing pressure forces exerted on said body means during pressurization of said flow passage when said valve means is in said closed position for preventing undesired opening of said valve means.

3. The control valve of claim 1 wherein:

said valve means comprises a seat disposed on said sleeve means and a ball valve element pivotally mounted in said seat; and said valve actuation means comprises an actuator arm attached to said body means and stationary with respect thereto, said actuation arm being engaged with said valve element such that, as said sleeve means is reciprocated with respect to said body means, said actuation arm pivots said valve element between said open and closed positions.

4. The control valve of claim 1 further comprising releasable connecting means for releasably connecting to said upper tool string portion.

5. The control valve of claim 1 wherein said valve means is in said open position when said body means and said sleeve means are in a relatively extended position, and said valve means is in said closed position when said body means and said sleeve means are in a relatively converged position.

6. The control valve of claim 1 futher comprising biasing means, disposed between said body means and said sleeve means, for relatively biasing said body means and said sleeve means toward said relatively converged position.

7. A subsurface control valve for use in a tool string, said subsurface control valve comprising:

a body attachable to one of an upper and a lower portion of said tool string, said body defining a central opening therethrough and having a valve actuator therein;

a sleeve slidably positioned in said body central opening and having an end extending therefrom, said end being attachable to the other of said upper and lower portions of said tool string; and a valve element positioned on said sleeve and engaged with said actuator, such that said valve element is moved from a closed position to an open position by relative sliding movement between said sleeve and said body from a relatively converged to a relatively extended position of said sleeve and body, said sleeve and body being disposed in said relatively extended position when said valve is subjected to the weight of said lower tool string portion.

8. The control valve of claim 7 further comprising biasing means for biasing said sleeve and body toward said relatively converged position.

9. The control valve of claim 8 wherein:

said body further comprises a radially inwardly extending shoulder in said central opening thereof;

said sleeve further comprises an outwardly extending shoulder thereon; and said biasing means is characterized by a spring positioned between said shoulders for biasing said shoulders apart.

10. The control valve of claim 8 wherein a force exerted by said weight of said lower portion of said tool string is greater than a maximum force exerted by said biasing means.

11. The control valve of claim 7 wherein said valve element is characterized by a full flow valve element such that said valve element, said body and said sleeve define a substantially unobstructed flow passage when said valve element is in said open position.

12. The control valve of claim 7 further comprising balancing means for balancing pressure forces created by pressure increases in said body central opening for preventing undesired movement of said valve element from said closed position to said open position.

13. The control valve of claim 12 wherein:

said body defines an annular piston cavity therein; and said balancing means comprises a piston reciprocably disposed in said piston cavity, whereby said piston cavity is divided into a first portion in communication with said flow passage and a second portion, said piston being movable in response to fluid pressure in said flow passage.

14. A downhole tool for subsurface closure of a well, said downhole tool comprising:

packer means forming a part of a lower tool string portion and having a set position sealingly closing an annulus of said well;

a full opening subsurface control valve defining a substantially unobstructed flow passage therethrough when in an open position, said valve including an outer portion attached to said releasable connecting means, an inner portion disposed in said outer portion and slidable with respect thereto from a relatively extended position in which said valve is in said open position to a relatively converged position in which said valve is in a closed position, said inner portion being attached to said packer means, and biasing means for relatively biasing said outer and inner portions to said relatively converged position;

releasable connecting means for releasably connecting said valve to an upper tool string portion; and means for closing said valve by longitudinally moving said upper tool string portion when said packer means is in said set position.

15. The apparatus of claim 14 wherein a weight of said lower tool string portion is sufficient to overcome said biasing means when said packer means is in an unset position such that said outer and inner portions of said subsurface control valve are maintained in said relatively extended position in which said valve is in said open position.

16. The apparatus of claim 14 wherein:

said outer and inner portions define a flow passageway therethrough; and said valve further comprises ball valve means rotatable from a position fully opening said passageway when said outer and inner portions are in said relatively extended position to a position closing said passageway when said outer and inner portions are in said relatively converged position.

17. The apparatus of claim 14 wherein said valve comprises pressure balancing means for balancing pressure forces created by pressurizing said flow passage in said valve when said valve is in said closed position for preventing undesired opening of said valve.

18. The apparatus of claim 17 wherein said valve defines a piston cavity therein, and further comprising:

a piston reciprocably and sealingly disposed in said piston cavity such that said cavity is divided into a first portion and a second portion; and a fluid connection between said piston cavity first portion and said flow passageway.

19. The apparatus of claim 18 further comprising a second fluid connection between said piston cavity second portion and said well annulus.

* * * * *